United States Patent [19]

Larson

[11] 4,187,928

[45] Feb. 12, 1980

[54] STEPLADDERS

[75] Inventor: Clayton E. Larson, Brooklyn, N.Y.

[73] Assignee: White Metal Rolling & Stamping Corp., Brooklyn, N.Y.

[21] Appl. No.: 883,578

[22] Filed: Mar. 6, 1978

Related U.S. Application Data

[63] Continuation-in-part of Ser. No. 775,850, Mar. 9, 1977, Pat. No. 4,079,814.

[51] Int. Cl.[2] ..... E06C 1/18; E06C 1/393; E06C 7/14

[52] U.S. Cl. ..... 182/124; 182/173

[58] Field of Search ..... 182/126, 125, 124, 174, 182/175, 173

[56] References Cited

U.S. PATENT DOCUMENTS 4,079,814 3/1978 Larson ..... 182/124

FOREIGN PATENT DOCUMENTS 831332 3/1960 United Kingdom ..... 182/125

*Primary Examiner*—Reinaldo P. Machado
*Attorney, Agent, or Firm*—Carroll F. Palmer

[57] ABSTRACT

Stepladders made of extruded aluminum channels include special forms of front section bracing and brackets for a bucket rack that enables the ladder to be fabricated with a minimum of fasteners and parts while providing improved strength, rigidity and safety properties.

5 Claims, 10 Drawing Figures

FIG. 1
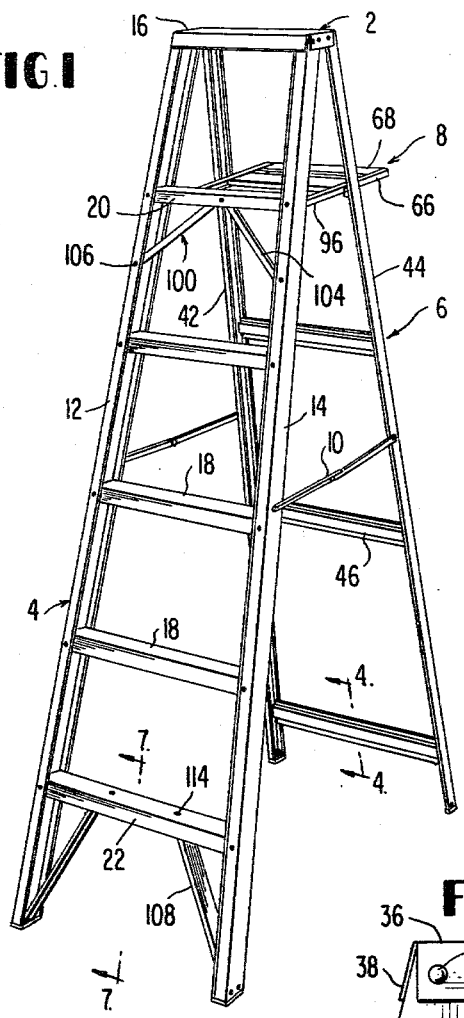
FIG. 2
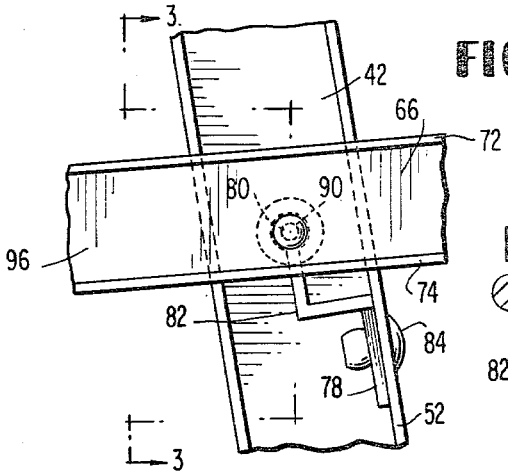
FIG. 9
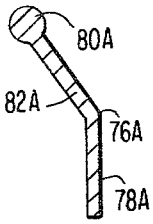
FIG. 3
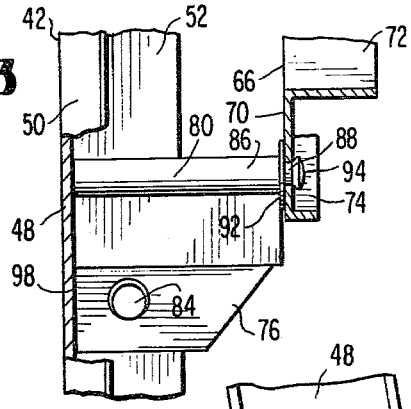
FIG. 10
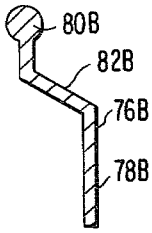
FIG. 8
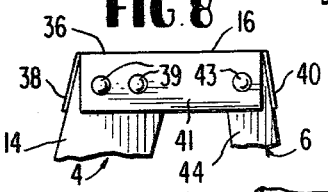
FIG. 4
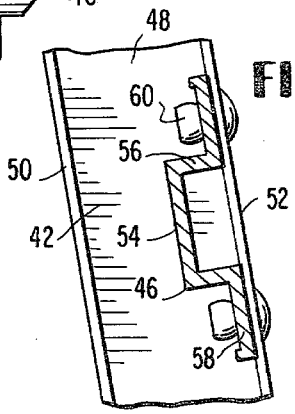
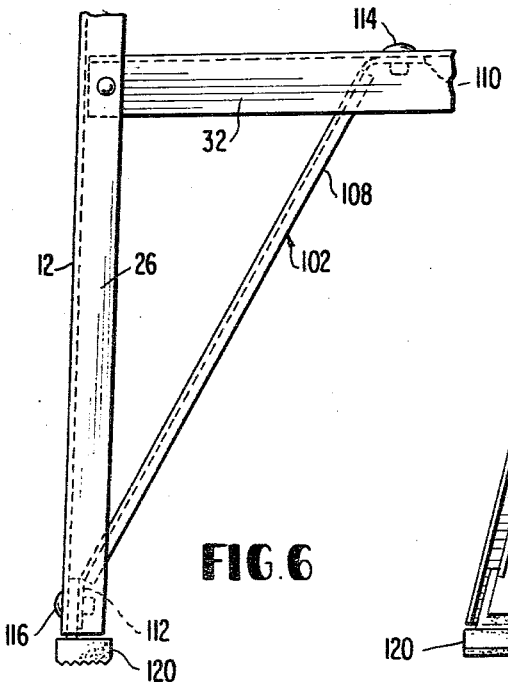
FIG. 6
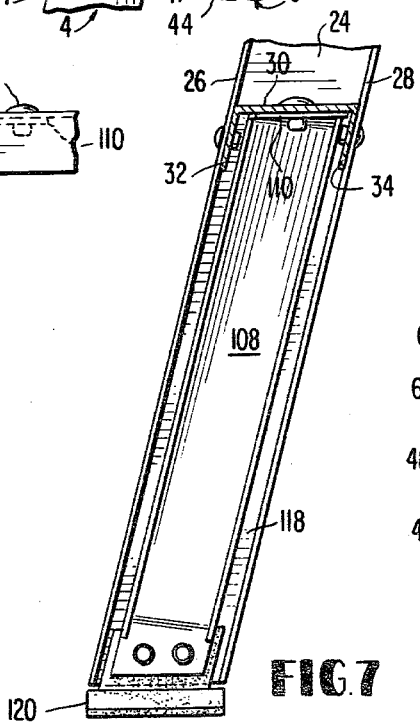
FIG. 7
FIG. 5
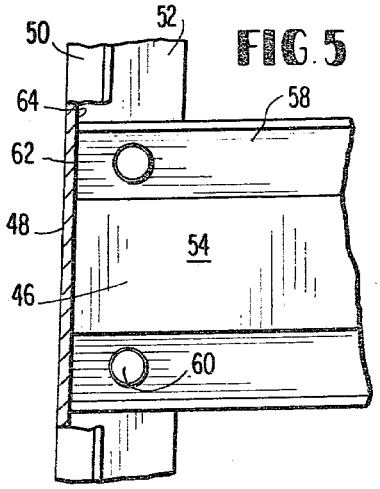

STEPLADDERS

CROSS-REFERENCE TO RELATED APPLICATION

This application is a continuation-in-part of co-pending application Ser. No. 775,850, filed Mar. 9, 1977, U.S. Pat. No. 4,079,814.

BACKGROUND OF THE INVENTION

1. Field of the Invention

This invention relates to stepladders. More particularly it concerns stepladders made of extruded aluminum metal parts structured so the ladders are extremely light weight and of low cost while possessing improved strength and rigidity.

2. Description of the Prior Art

Ladder manufacturers strive to create ladders from a minimum of parts and material to make them as light in weight and low in cost as possible. Stepladders designed with such considerations in mind are disclosed in many prior patents, e.g., U.S. Pat. Nos. 2,899,008, 3,009,535 and Ser. No. 775,850.

There tends to be a conflict in ladder construction between strength and stability versus light weight and minimum material of construction. Thus, as the number of parts and weight of material used in fabrication of ladders is decreased, there is an increased tendency for the strength and rigidity of the ladders to decrease. By way of example, light weight stepladders frequently exhibit unsatisfactory torsional twisting of the rear section relative to the front section during use. Also, pantographing or rotation often occurs in the rear sections of light weight ladders. Moreover, proper bracing of the front section and bucket rack support are problems in such ladders.

Notwithstanding the large number of new designs of ladders that have been developed over the years, there continues to be a need for the creation of stepladders that possess high strength and stability combined with light weight, low material requirement and low cost of fabrication.

OBJECTS

A principal object of the present invention is the provision of new improvements in stepladders. Further objects include the provision of stepladders that:

(1) Are of light weight, but have good strength, rigidity, stability and safety properties.

(2) Are formed of extruded aluminum parts structured to require a minimum of rivets for assembly.

(3) Incorporate unique front section braces.

(4) Include novel bucket rack brackets.

Other objects and further scope of applicability of the present invention will become apparent from the detailed description given hereinafter; it should be understood, however, that the detailed description, while indicating preferred embodiments of the invention, is given by way of illustration only, since various changes and modifications within the spirit and scope of the invention will become apparent to those skilled in the art from this detailed description.

SUMMARY OF THE INVENTION

The foregoing objects are accomplished in accordance with the present invention by a stepladder construction that is characterized by the following features:

A. a front section comprising side rails and steps made of metal channels,

B. A rear section comprising metal channel side rails and horizontal brace members of dished shape fixed with ends abutting the side rails to provide a rigid construction that prevents pantographing or rotation without need for diagonal bracing, C. A bucket rack pivoted on special shaped brackets fixed by a single rivet to the rear section side rails, and D. lower front section bracing that comprises wide, obliquely angled, channel struts having angled lugs at each end with one of such lugs fixed to the undersurface of the lowermost step of the ladder by a single fastener and the opposed lug being fixed by a pair of fasteners to the respective side rail of the ladder.

Through the utilization of a pair of foot mounting rivets for attachment of their lower ends, the wide lower front section braces provide two additional rivet shear surfaces on each side of the ladder doubling mounting strength as well as supporting the foot member through transmission of force at the cross-sectional end of each brace and clamping the vertical extension of a resilient foot member firmly between two metal webs in sandwich fashion. This type lower end connection the wide brace members inhibits torsional twisting under load of the ladder side rails. In addition, the upper end, obliquely formed, wide channel supports the primary width of the tread which is where the stepping load is applied and due to its width and rigidity permits the use of only one top end rivet.

The innovation in the case of the unique bucket rack mountings of the invention reduce the bucket rack mounting requirement from six to two rivets through the use of a unique extrusion which is shaped to provide a substitution for the pivot rivet by blanking away all but the rod or lug section of the extrusion to a point providing adequate length for developing a rivet head once the bucket rack channel or angle has been mounted, as well as to provide a bearing for this channel or angle locating its lateral position on the ladder and providing enough clearance so that the bucket rack when folded will clear the rear side rails which are mounted with a longitudinal taper.

In addition the shape of the bracket is such as to locate the bucket rack when folded completely within the rear side rails and provide a rivet mounting member to attach to the flange or leg of the rear side rail. The bracket is constructed with sufficient length to nest against the inside of the web of the rear side rail and prevent the bracket from misalignment. The outer end of the bracket is blanked in its manufacture at an angle to nest securely against the inside of the web of the side rail and still provide a bearing surface in the same planetary direction as the mounting surface of the bucket rack channel or angle.

Other objects and further scope of applicability of the present invention will become apparent from the detailed description given hereinafter; it should be understood, however, that the detailed description, while indicating preferred embodiments of the invention, is given by way of illustration only, since various changes and modifications within the spirit and scope of the invention will become apparent to those skilled in the art from this detailed description.

BRIEF DESCRIPTION OF THE DRAWINGS

A more complete understanding of the new stepladders of the invention may be had by reference to the accompanying drawings in which:

FIG. 1 is a perspective view of a stepladder constructed in accordance with the invention.

FIG. 2 is fragmentary, lateral view of the bucket rack bracket portion of the ladder.

FIG. 3 is a fragmentary, sectional view taken on the line 3—3 of FIG. 2.

FIG. 4 is a fragmentary, sectional view taken on the line 4—4 of FIG. 1.

FIG. 5 is a fragmentary, plan view, partially in section, of the end of a horizontal brace member of the ladder.

FIG. 6 is a fragmentary, plan view of one of the lower ends of the front section of the ladder.

FIG. 7 is a fragmentary, sectional view taken on the line 7—7 of FIG. 1.

FIG. 8 is a fragmentary, lateral view of the top of the ladder.

FIGS. 9 and 10 are sectional views of alternative forms of bucket rack brackets for the ladder.

DESCRIPTION OF THE PREFERRED EMBODIMENTS

Referring in detail to the drawings, the new stepladder 2 comprises a front section 4, a rear section 6, a bucket rack 8 and spreaders 10.

The front section 4 comprises left side rail 12, right side rail 14, a top step 16 and a plurality of lower steps 18, including the next-to-top step 20 and bottom step 22.

The side rails 12 and 14 are formed of channels having a face 24 and a pair of normal legs 26 and 28. The lower steps 18 are formed of channels each having a face or tread 30 and two normal legs 32 and 34.

The top step 16 is a channel having a face or tread 36, front and rear legs 38 and 40 and side legs 41. The side legs 41 are formed by having the top step channel longer than required, cutting away end portions (not shown) of the legs 38 and 40 to form extensions at either side and then bending these extensions inwardly to form the pair of side legs 41. Hence, the top step is like a rectangular pan positioned upside down on the top of the ladder. The top step 16 is fixed to side rails of the front section 4 by a pair of rivets 39 that extend through the end legs 41 and the rear section 6 is pivoted upon the step 16 by a single rivet 43.

The rear section 6 comprises left side rail 42, right side rail 44 and a plurality of spaced apart, horizontal brace members 46. The side rails 42 and 44 are channels having a face portion 48 and two normal legs 50 and 52 that extend inwardly of the sides of the ladder.

The brace members 46 are channels having a central web 54, two normal legs 56 and lugs 58 extending laterally from each leg 56. The brace members 46 are fixed to the side rails 42 and 44 (see FIG. 5) by rivets 60 that extend through the lugs 58 and the legs 52 of the side rails. The ends 62 of the members 46 abut the innersurface 64 of the face portion 48 to assist in preventing pantographing of the rear section 6.

The bucket rack 8 comprises a pair of spaced apart, longitudinal members 66 and cross slats 68. The members 66 are channels having a face portion 70 and normal legs 72 and 74.

The bucket rack 8 is supported by a pair of brackets 76 each comprising a flat base portion 78, a cylindrical bearing portion 80 and a connecting web portion 82 integral with portions 78 and 80. The base portion 78 is fastened by rivet 84 to the leg 52 of the respective rear section side rail. The inboard end 86 of the bearing portion 80 is machined to form a reduced diameter axial extension 88 which extends through a corresponding hole 90 in the channel face portion 70, with the washer 92 sandwiched between end 86 and face portion 70, and the end of the extension 88 is peened to form the retaining cap 94. The longitudinal members 66 are sufficiently long so that the ends 96 thereof will engage the rear of step 20 to support the bucket rack 8 in the lowered position as shown in FIG. 1. For storage, the rack 8 is swung upwardly so that members 66 are aligned with the side rails 42 and 44.

The ends 98 of brackets 76 abut the innersurface of the respective side rail, e.g. the face portion 48 of the side rail 42 to prevent the brackets 76 from twisting. This arrangement makes it possible to use only one rivet 84 to fix the brackets 76 to the side rails.

An alternative form of bracket 76A is shown in FIG. 9. This comprises the flat base portion 78A, bearing portion 80A and connecting web portion 82A.

Another alternative form of bracket 76B is shown in FIG. 10. This comprises the flat base portion 78B, bearing portion 80B and connecting web portion 82B.

Any of the bucket rack brackets 76, 76A or 76B may be mounted as shown in FIG. 2 with the bearing portions 80, 80A or 80B respectively above the rivet 84. Alternatively, the mounting may be reversed so that the rivet 84 will be above the bearing portion. Suitable adjustments in the length of the brackets 76, 76A or 76B can be made, if necessary, to accomplish the inverse mounting arrangement while providing sufficient clearance between the side rails 42 and 44 and the bucket rack channels 66.

The front section 4 is braced by upper brace means 100 and lower brace means 102. The former comprises a pair of straps 104 riveted at their outboard ends by rivets 106 to legs 26 of the side rails 12 and 14. The inboard ends of straps 104 are fixed by a single rivet to the leg 32 of step 20.

The lower brace means 102 comprises a pair of channel struts 108 each having angled lugs 110 and 112 upon their ends. The lug 110 is fixed by rivet 114 to the undersurface of step 22 and the opposed angled lug 112 is fixed by rivet 116 to the innersurface 118 of the respective side rail 12 or 14, with the T-shaped foot pads 120 locked in between. Hence, by the use of only four rivets the mold rubber foot pads 120 and the lower brace means 102 are fastened to the new ladders.

The embodiments of the invention in which an exclusive property or priviledge is claimed are defined as follows:

1. A metal stepladder comprising a front section including left and right side rails, a top step and a plurality of spaced apart lower steps fixed between said side rails, each of said side rails and steps being channels having a face portion and two legs, the legs of the side rail channels extending inwardly of the sides of the ladder and the legs of the channels of the steps all extending downwardly relative to the upright position of the ladder, a rear section pivoted to the front section comprising left and right side rails, each of said side rails being channels having a web portion and legs, and a plurality of spaced apart, horizontal brace members, a pair of brackets fixed upon said rear section, each bracket comprising a flat base portion, a cylindrical bearing portion offset from said base portion and a connecting web portion integral with the base portion and bearing portion, the base portion of each bracket being fastened to one of the legs of a rear section side rail with the cylindrical bearing portion of the bracket between the legs of said rear section side rail and extending normally and inwardly of the face portion thereof, a bucket rack comprising a pair of spaced apart, longitudinal members, said rack being pivoted on said rear section by a part of said cylindrical bearing portions of said brackets extending through openings in said longitudinal members, and brace means on said front section comprising a pair of channel struts each having an angled lug at each end, one of said angled lugs being fixed to the undersurface of the lowermost step of the ladder and the opposed angled lug being fixed to the innersurface of the respective front section side rail at the lower end of such rail.

2. The stepladder of claim 1 wherein said lugs of said struts of said brace means are fixed to said respective undersurface and innersurface by a single rivet through each lug.

3. The stepladder of claim 2 wherein foot-pads are fixed upon the lower ends of the front section side rails by the single rivets that extend through the respective strut lug and front section side rail.

4. The stepladder of claim 3 wherein said brackets are fixed to the respective rear section side rail channel by a single rivet.

5. The stepladder of claim 1 wherein said channel struts have a width substantially wider than one-half the width of the tread portion of said lowermost step.

* * * * *